US005201347A

United States Patent [19]

Maina

[11] Patent Number: 5,201,347

[45] Date of Patent: Apr. 13, 1993

[54] WEFT FEEDER HAVING YARN RESERVE WINDING UNIT WITH ADJUSTABLE CROSS SECTION

[75] Inventor: Bruno Maina, Valdengo, Italy

[73] Assignee: Roj Electrotex S.p.A., Biella, Italy

[21] Appl. No.: 738,429

[22] Filed: Jul. 31, 1991

[30] Foreign Application Priority Data

Aug. 3, 1990 [IT] Italy ..... 21205 A/90

[51] Int. Cl.[5] ..... D03D 47/34

[52] U.S. Cl. ..... 139/452

[58] Field of Search ..... 139/452; 242/47.01

[56] References Cited

U.S. PATENT DOCUMENTS 4,367,773 1/1983 Newcomb ..... 139/452
4,643,369 2/1987 Van Donk ..... 242/47.01
4,645,134 2/1987 Sarfati ..... 242/47.01
5,046,536 9/1991 Zenoni ..... 139/452
5,046,537 9/1991 Maina ..... 139/452

*Primary Examiner*—Andrew M. Falik
*Attorney, Agent, or Firm*—Young & Thompson

[57] ABSTRACT

In a measuring weft feeder for fluid jet looms, of the type having a winding unit with adjustable cross section and comprising a cage wall formed of two sets of alternating columns mounted on reciprocally slanting flanges so as to move forward the yarn reserve into separate turns. The sets of columns (preferably divided into evenly spaced groups or sectors) are mounted on the respective flanges by way of structure adopted to adjust their radial position, this structure acting simultaneously and to an equal extent on both sets of columns and being operated by a single control member.

12 Claims, 3 Drawing Sheets

WEFT FEEDER HAVING YARN RESERVE WINDING UNIT WITH ADJUSTABLE CROSS SECTION

BACKGROUND OF THE INVENTION

1. Field of the Invention

The present invention concerns a weft feeder for fluid jet looms, of the type which also measures the weft yarn lengths to be fed (measuring weft feeder) and wherein the weft yarn reserve winding unit or drum has an adjustable cross section.

More particularly, the invention concerns improvements in such a weft feeder, to allow a precise and efficient and, at the same time, easy and rapid adjustment of the cross section of the winding unit—satisfactorily adopted on an industrial level—and thus of the weft yarn lengths winding around the same.

It is known that, in modern weaving technique with fluid jet looms, use is commonly made, to feed the weft, of measuring weft feeders interposed between the yarn feed spool or reel and the loom.

Weft feeders of this type comprise an electric motor causing the rotation of a yarn distributing or winding arm, and a winding unit in the form of a drum, held stationary, around which the arm winds up the yarn into even turns, forming a weft yarn reserve the length of which is detected by means of suitable sensors.

The loom nozzle, preset to launch the weft yarn in the warp shed, draws from the weft feeder drum the yarn length required for each insertion.

This length is measured and controlled by the actual weft feeder by counting, with suitable means, the number of yarn turns being unwound.

As soon as the weft yarn at the outlet of the weft feeder and launched into the loom shed has reached the predetermined length, it is stopped on the weft feeder drum by means of a device—generally an electromagnetic device—comprising a rod apt adapted to engage and stop the yarn at the outlet of the winding unit. This rod is movable between a withdrawn rest position and a projecting yarn stopping position in which its end moves into a cavity formed on the drum periphery, close to its free end, to thereby stop the weft yarn which bears against the rod as it unwinds from the drum.

2. Description of the Prior Art

To measure the weft yarn length at each insertion, two different solutions are generally adopted:

the cross section of the winding unit (and thus the perimeter of the section—usually a circumference—and the length of the single yarn turns winding around the same) is kept constant, and a plurality of yarn stopping devices is mounted around the outlet end of the unit, so as to carry out a discrete measurement of the weft yarn length to be inserted in integer turn numbers and turn fractions;

or, alternatively, the cross section of the winding unit (and thus the perimeter of the section—usually a polygon as close as possible to a circumference—and the length of the single yarn turns winding around the same) is varied, and a single yarn stopping device is mounted at the outlet end of said unit, so that the weft yarn length fed to the loom is always equal to an integer number of turns unwound from the unit, thereby obtaining a continuous measurement of the weft yarn length to be inserted at each beating up.

Both of these solutions have long been adopted in constructing measuring weft feeders for fluid jet looms. Obviously, they are not equivalent from the technical point of view, either as far as difficulties of construction and as far as performances.

The solution providing for a fixed cross section of the winding unit is currently preferred when more interest is placed in the quality of the winding of the reserve turns, in that it allows—without too many construction difficulties—to arrange and move forward the yarn turns separately on the winding unit; this characteristic is greatly appreciated and particularly advantageous when weaving highly twisted and very hairy yarns or parallel filaments with no twist.

On the other hand, the presence in the aforementioned solution of a plurality of yarn stopping devices increases the structural complexity and the cost of the measuring unit and, furthermore, it does not allow the continuous measurement of the weft yarn length to be inserted.

The solution providing for an adjustable cross section of the winding unit, and thus for an adjustable length of the yarn turns, is generally less complex from the constructional point of view. In fact, in this case, a single yarn stopping device is normally provided, which can thus be optimally realized with no problems of having to limit the costs and dimensions; in some cases, however, in order to reduce the adjustment range of the cross section perimeter of the winding unit, more yarn stopping devices are provided, through still of very reduced number (up to four).

On the other hand, the requirement to adjust the cross section of the winding unit does not allow to freely choose the system moving forward the yarn turns.

In fact, the systems generally adopted to obtain the advancement of the yarn turns are, above all, of the sliding forward type, wherein the turns being wound around the drum push forward the previously wound up turns, and of the oscillating disk type, wherein the yarn turns are moved forward one close to the other thanks to a disk positioned next to the winding arm, which performs an oscillating movement about the weft feeder axis.

The construction of a weft feeder for fluid jet looms, of the type having a winding unit with adjustable cross section in which the advancement of separate yarn turns is simultaneously obtained, combines the advantages of both previously described systems, although involving considerable structural complications.

It is known, in fact, that the system moving forward the yarn turns separately provides for a winding unit having a cage wall formed by fixed and, alternately, movable columns, wherein the reciprocating movement of said columns—caused by the rotation of the driving shaft—determines an axial advancement of the turns towards the outlet end of the drum, while positively keeping the turns mutually spaced.

A correct advancement of the yarn turns on the winding unit is determined by the mutual radial position of the columns, in that the movable columns partially and variably emerge from the periphery of the fixed columns, thanks to the motion imparted thereto by the weft feeder driving shaft.

The extent to which the movable columns emerge from the fixed ones determines the pitch or distance between the yarn turns and thus the number of turns which can be wound around the winding unit.

This is an important characteristic of the weft feeder, in that the number of yarn turns which can be stored on the drum determines the weft feeding capacity in meters per minute.

Thus, in a weft feeder having a winding unit with adjustable cross section and wherein the yarn turns are moved forward separately, it is necessary for the evenness of the pitch and of the forward motion of the turns to be kept constant when adjusting the cross section of the winding unit and its perimetral length.

A weft feeder for fluid jet looms of the type specified heretofore is known from FR-2626014. In this feeder, the adjustment of the radial displacement of the alternately fixed and movable columns, divided into four pairs of groups or sectors, is obtained by loosening fastening screws, by manually shifting each single group or sector of columns along radial slits, and by subsequently tightening the screws.

A manual adjustment is hence performed, which is not easy and quick to carry out especially for the following reasons:

The adjustment of the groups or sectors of fixed and movable columns has to be carried out individually, sector by sector, on each pair of sectors, with the risk of altering each time the reciprocal adjustment—which has to be particularly precise—between the sector of fixed columns and that of movable columns in each pair.

The reciprocal positioning of the groups or sectors of movable and fixed columns is anyhow left to the perception of the operator who carries out the adjustment.

The operations require considerable ability and long intervention times.

As can be noted, the solution of FR-2626014—although providing the undoubted advantages of a winding unit with adjustable cross section and yarn advancement in separate turns—does not answer the requirements of reliability and easiness of use which need to be satisfied in an industrial machine, especially if designed for the textile field, wherein the conditions of use are extremely strict and it is of primary importance to be able to perform any adjustment operations most easily.

On the basis of the above, it appears of evident interest to be able to provide a measuring weft feeder for fluid jet looms having a winding unit with adjustable cross section and yarn advancement into separate turns, wherein the cross section of the unit may be adjusted through a centralized control, namely wherein the operation of a single adjustment member is adapted to simultaneously shift all the fixed and movable columns alternately in the unit, keeping moreover constant their reciprocal position and ensuring the evenness of the pitch between the turns when adjusting the cross section of the winding unit and the length of the yarn turns wound thereon.

SUMMARY OF THE INVENTION

The problem is solved in a fully satisfactory way by the present invention which concerns a weft feeder for fluid jet looms, of the type which also measures the weft yarn lengths to be fed (measuring weft feeder) and which can be equipped with a single yarn stopping device or possibly with a limited number of such devices, comprising a winding unit or drum, a winding arm adapted to distribute on the drum a weft yarn reserve, means to detect the length of the yarn reserve and to measure the weft yarn length drawn from the reserve at the outlet of the weft feeder, and means to stop the yarn being unwound, and wherein the winding unit has an adjustable cross section and comprises a cage wall formed of two sets of alternating columns mounted on mutually inclined flanges, so as to move forward the yarn reserve into separate turns, characterized in that, said sets of columns are mounted on the respective flanges by way of means adapted to adjust their radial position, said means acting simultaneously and to an equal extent on both sets of columns, and being operated by a single control member.

Preferably, in the weft feeder, each set of columns is divided into groups or sectors, each comprising a plurality of columns.

The weft feeder also comprises means to lock the sets of columns (or the groups or sectors into which they are divided) in the selected radial position reached through said adjustment means, as well as a control member operating said locking means.

Preferably, the locking means are operated by the same control member which operates the adjustment means.

According to a preferred embodiment of the invention, the means to adjust the radial position of the columns or groups of columns of the sets comprise two disks mounted coaxially and rotating on the flanges and having cam profiles with which engage cam followers of the columns or groups of columns of the two respective sets, the two disks comprising toothings with which engage corresponding toothings of two sprockets adapted to be simultaneously rotated by single control means.

BRIEF DESCRIPTION OF THE DRAWINGS

The invention is now described in further detail, by mere way of example, with reference to the accompanying drawings, which show two preferred embodiments thereof and in which.

DESCRIPTION OF THE PREFERRED EMBODIMENTS

Figure 1:
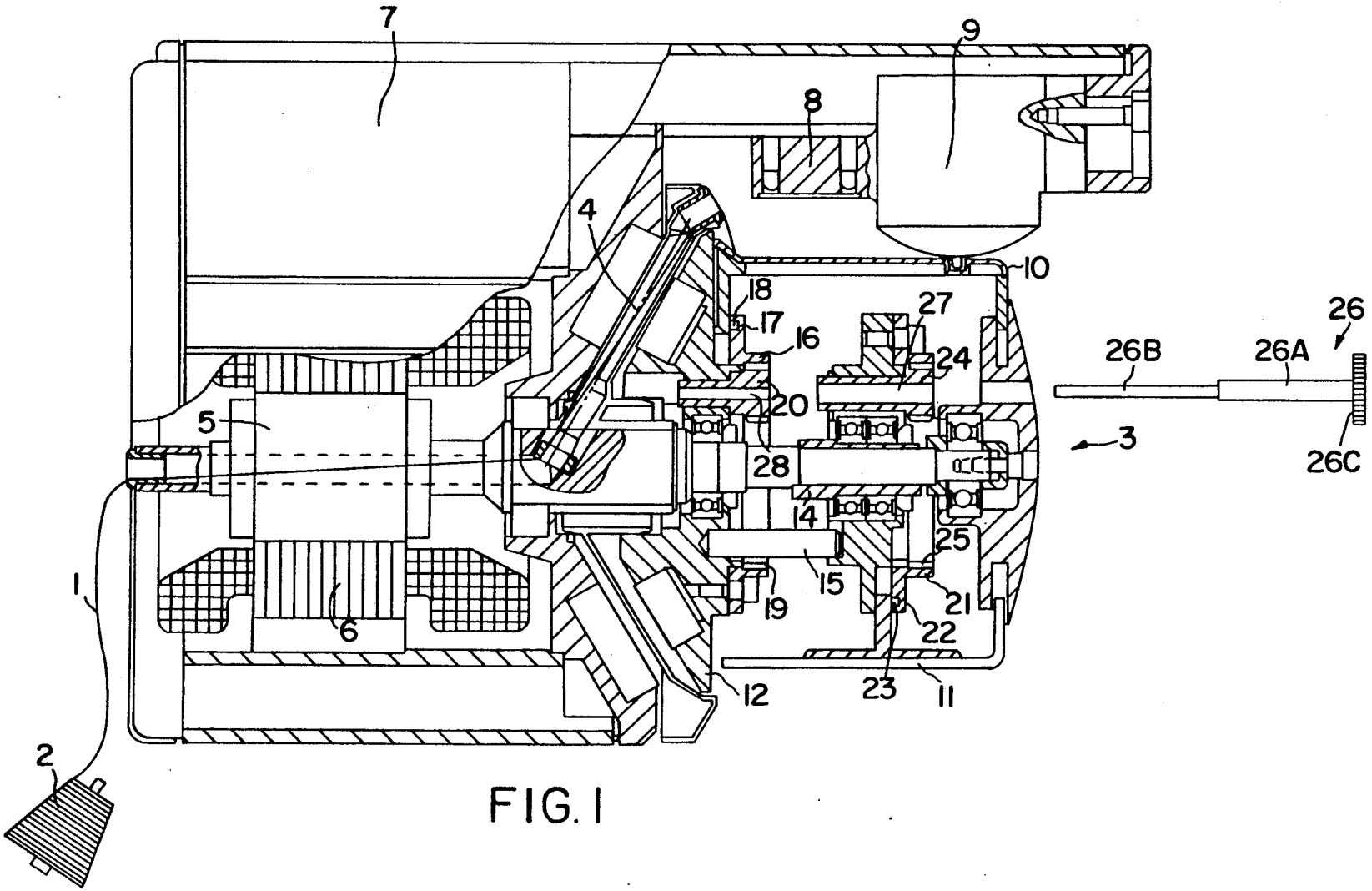
FIG. 1 is an axial longitudinal cross section view of a first embodiment of the measuring weft feeder according to the invention.
Figure 2:
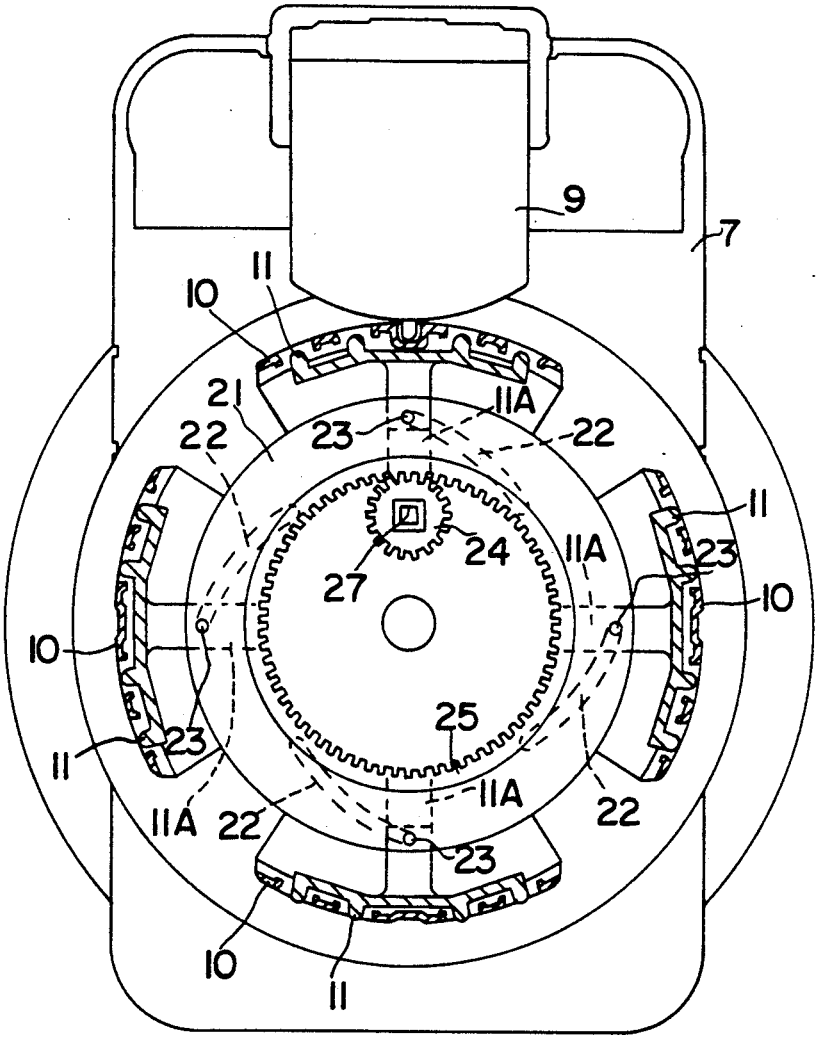
FIG. 2 is a front view (from the outlet end) of the weft feeder of FIG. 1, showing in detail only the parts of the winding unit concerning the invention.

With reference to FIGS. 1 and 2 of the drawings, the measuring weft feeder according to the invention comprises—in known manner—a winding unit or drum 3 around which the weft yarn 1, drawn from the spool 2, is wound up by the winding arm 4, the driving shaft 5 of which is caused to rotate by the electric motor 6.

To the weft feeder body 7 there are applied—again in known manner—the devices 8 adapted to detect the yarn reserve and count the number of turns being unwound, and the device 9 adapted to stop the yarn. These devices are radially adjustable so as to be kept at an optimal distance from the winding unit 3 when adjusting its cross section.

As shown in the drawings, the winding unit 3 comprises a cage wall formed of a first set of columns 10 and of a second set of columns 11, alternating with each other, both sets being concentrated in distinct groups or sectors. The columns of the first set, centered on the weft feeder axis, can be defined as fixed, while the columns of the second set, eccentric and oblique with respect to said axis, are adapted to oscillate and can thus be defined as movable. As shown in FIG. 2, each set of columns is divided into four groups comprising, respectively, five fixed columns 10 and four movable columns 11 being positioned, in association, evenly spaced so as to form the cage wall of the winding unit 3. The fixed columns 10 are connected to the fixed flange 12, which is centered with respect to the driving shaft 5; while the movable columns 11 are connected to the movable flange 13, which is mounted oblique to the driving shaft 5 by interposing the bush 14 with slanting axis which, in know manner, causes the oscillation of the movable columns allowing to move forward the yarn turns on the winding unit 3.

According to the invention, the flanges 12 and 13 are connected by one or more longitudinal elements 15, preventing any reciprocal angular displacements thereof and thereby excluding all contact between the neighboring fixed and movable columns.

Further according to the invention, the radial position of the fixed and movable columns can be simultaneously adjusted to an equal extent, for all the columns, thanks to cam systems: more precisely, the fixed flange 12 carries a disk 16 having grooves 17, substantially spiral-shaped in the form of cams—all alike—in which engage pins 18, parallel to the axis of the flange 12, applied on the groups of fixed columns 10 and acting as cam followers.

The cam disk 16 is adapted to rotate on the fixed flange 12 by means of a gearwheel control, which comprises a toothing 19 of the cam disk 16 with which engages a sprocket 20 mounted idle on the fixed flange 12.

Likewise, on the movable flange 13 there is rotatably fixed a disk 21 having grooves 22, substantially spiral-shaped in the form of cams identical to those of the disk 16, in which engage pins 23, parallel to the axis of the flange 13, applied to the groups of movable columns 11 and acting as cam followers.

Each sector or group of fixed columns and of movable columns is guided in its radial movements by grooves. FIG. 2 shows the grooves 11A guiding the radial movements of the groups of movable columns 11.

The cam disk 21 is adapted to rotate on the flange 13 thanks to the engagement of a sprocket 24 with a toothing 25 of said disk.

The rotation of the cam disks 16 and 21 thus causes the radial shifting of the groups or sectors of columns; the radial shifting is obtained simultaneously and to an equal extent for all the groups or sectors of columns, both fixed and movable, the two sprockets 20 and 24 being simultaneously operated so as to never alter the mutual radial position between the columns 10 and the columns 11 of all the groups or sectors.

This simultaneous operation of the sprockets 20 and 24 can on the other hand be very simply obtained by acting with a suitable control member, adapted to operate both sprockets and formed in such a way as to prevent the operation of a single sprocket.

According to the embodiment shown in FIG. 1, such a control member consists of a bar 26, having two differently shaped sections 26A and 26B as well as a control handle 26C.

The control member 26 engages in the central cavities 27 and 28 of the two sprockets 24 and 20 of the movable and respectively fixed flanges 13 and 12, the double-section configuration of said member allowing to operate at the same time both sprockets, which is indispensable in order to simultaneously operate all the movable and fixed columns forming the winding unit 3 of the weft feeder, without causing any mutual displacements between the cam disks 21 and 16.

Since the movable flange 13 has an oscillating motion, the axis of the sprocket 24 will not always be aligned with that of the sprocket 20; there are however two angular positions of the driving shaft in which the two axes are practically aligned and these positions can be easily found by manually rotating the winding arm 4: it is thus possible to set the weft feeder in suitable conditions to carry out the adjustment of the cross section of the winding unit 3 and to thus adjust the length of the yarn turns being wound thereon.

Figure 3:
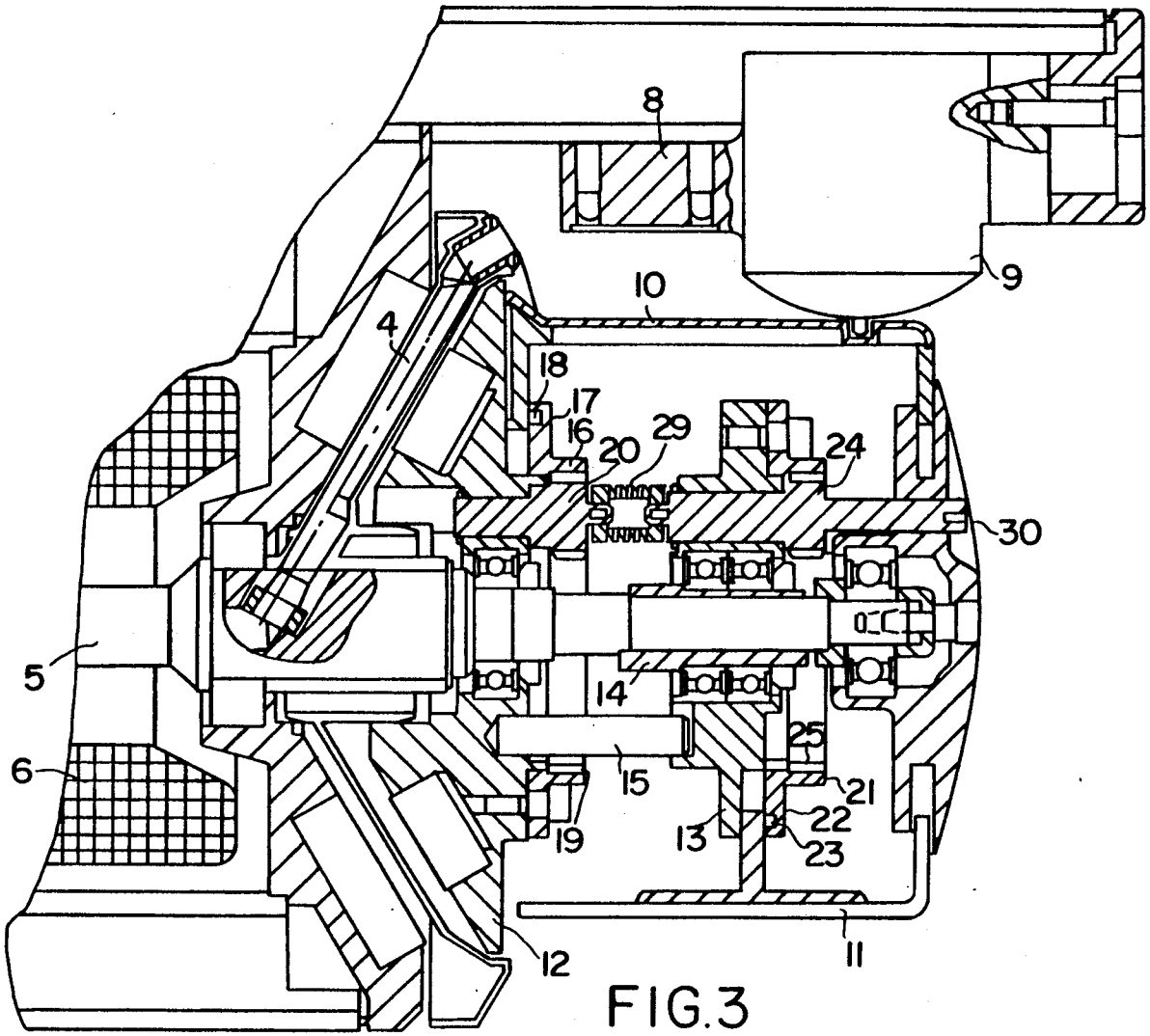
FIG. 3 is an axial longitudinal cross section view of a second embodiment of the measuring weft feeder according to the invention.

The embodiment of FIG. 3 provides for a different system to simultaneously operate the two sprockets 20 and 24. In this case, the sprockets are connected by interposing a semi-elastic joint 29, whereby they can both be operated by acting merely on the outermost sprocket 24.

The joint 29, which is elastic to bending and tensile stress but rigid to torsional stress, is adapted to stand without any problems the changes of alignment between the axes of the two sprockets 20 and 24, which take place during the rotation of the driving shaft 5, while allowing no mutual angular displacements between the sprockets.

The outermost sprocket 24, which controls the movable columns 11, can be directly operated by acting on a tang 30 thereof, with the use of common tools such as a screwdriver (or with a purely manual operation if a control handle is provided on the tang 30).

The described system to simultaneously adjust the radial position of the fixed and movable columns can obviously be adopted also in the case of the columns being arranged as single units, besides that in which they are grouped into sectors according to the configuration illustrated by way of example in FIG. 2 and described heretofore.

Obviously, once adjusted, the position of the columns or of the groups of columns has to be kept constant up to the next adjustment.

For this purpose, elementary locking means—not shown—are provided, which could consist for example of screw means adapted to fix by pressure the flanges 12 and 13 on the disks 16 and 21 respectively, and on the interposed columns 10 and 11. Alternatively, the sectors of columns could be stopped in their radial guides by means of rubber inserts, or inserts of other high-friction material, so that they can be moved only by imparting very strong adjustment forces.

It is to be understood that there may be other practical embodiments of the invention differing from those described and illustrated.

It should be noted, for example, that in the weft feeder embodiments described heretofore, the cross section of the winding unit has been modified by evenly adjusting the radial position of all the columns or groups of columns, and thus keeping the position of the winding unit centered on the axis of the weft feeder and its shape substantially cylindrical (at the most, slightly prismatic).

It is instead possible to unevenly adjust the radial position of the different columns or groups of columns, particularly by keeping stationary some columns or groups of columns and adjusting the position of the other ones only. In such cases, one obtains a winding unit which is no longer centered on the weft feeder axis, as—for example—in U.S. Pat. No. 5,046,537.

This can be done by using cam systems with cams having different profiles instead of equal profiles, which profiles are chosen according to the shape designed for the cross section of the winding unit (which shape will anyhow always be similar to that of a circumference) and according to the position which the winding unit is meant to take up with respect to the weft feeder axis.

With an arrangement like that just described one obtains the advantage of not having to adjust, with the position of the columns, also the radial position of the weft yarn stopping device and of the yarn reserve detecting devices, as must instead be done when the winding unit is centered on the weft feeder axis.

I claim:

1. In a weft feeder for fluid jet looms, of the type comprising a winding unit or drum, a winding arm adapted to distribute on said drum a weft yarn reserve, means to detect the length of said yarn reserve and to measure the weft yarn length drawn from said reserve at an outlet of the weft feeder, and means to stop the yarn being unwound, and wherein the winding unit has an adjustable cross section and comprises a cage wall formed of two sets of alternating columns mounted on mutually inclined flanges, so as to move forward the yarn reserve in separate turns; the improvement wherein said sets of columns are mounted for radial movement on the respective flanges by means to adjust their radial position for adjusting the yarn turn length, a single control member for simultaneously actuating the last-named means of both sets of columns.

2. Weft feeder as in claim 1, wherein each of said sets of columns is divided into groups or sectors, each comprising a plurality of columns.

3. Weft feeder as in claim 2, comprising moreover means to lock the sets of columns in a selected radial position reached through said adjustment means.

4. Weft feeder as in claim 3, comprising also a control member operating said locking means.

5. Weft feeder as in claim 4, wherein said locking means are constructed and arranged to be operated by the same control member which operates said adjustment means.

6. Weft feeder as in claim 1, wherein said means to adjust the radial position of the columns or groups of columns of said sets comprise two disks, mounted coaxially and rotating on said flanges, having cam profiles with which engage cam followers of the columns or groups of columns of the two respective sets, and wherein said two disks comprise toothings with which engage corresponding toothings of two sprockets adapted to be simultaneously rotated by said single control means.

7. Weft feeder as in claim 6, wherein said cam profiles are all alike.

8. Weft feeder as in claim 1, wherein said means to adjust the radial position of the columns or groups of columns of said sets comprise two disks, mounted coaxially and rotating on said flanges, having cam profiles with which engage cam followers of the columns or groups of columns of the two respective sets; wherein said two disks comprise toothings with which engage corresponding toothings of two sprockets adapted to be simultaneously rotated by said single control means; and wherein said cam profiles differ from one column to the other, or from one group of columns to the other.

9. Weft feeder as in claim 1, wherein said means to adjust the radial position of the columns or groups of columns of said sets comprise two disks, mounted coaxially and rotating on said flanges, having cam profiles with which engage cam followers of the columns or groups of columns of the two respective sets; wherein said two disks comprise toothings with which engage corresponding toothings of two sprockets adapted to be simultaneously rotated by said single control means; and wherein said cam profiles are grooves formed on said disks, and said cam followers are pins projecting from the columns or from the groups or sectors of columns.

10. Weft feeder as in claim 9, wherein the cam grooves of said disks are substantially spiral-shaped and the pins of said columns or groups of columns are positioned parallel to the axis of the respective flange.

11. Weft feeder as in claim 1, wherein said means to adjust the radial position of the columns or groups of columns of said sets comprise two disks, mounted coaxially and rotating on said flanges, having cam profiles with which engage cam followers of the columns or groups of columns of the two respective sets; wherein said two disks comprise toothings with which engage corresponding toothings of two sprockets adapted to be simultaneously rotated by said single control means comprising a control handle and a bar having two differently shaped sections configured to engage into correspondingly different shaped central cavities of said sprockets.

12. Weft feeder as in claim 1, wherein said means to adjust the radial position of the columns or groups of columns of said sets comprise two disks, mounted coaxially and rotating on said flanges, having cam profiles with which engage cam followers of the columns or groups of columns of the two respective sets; wherein said two disks comprise toothings with which engage corresponding toothings of two sprockets adapted to be simultaneously rotated by said single control means; and wherein said two sprockets are axially connected for rotation by semielastic joint, which is elastic to bending and tensile stress but rigid to torsional stress, and their simultaneous rotation is obtained by acting on one of said sprockets.

* * * * *